US005801626A

United States Patent [19]

Addy

[11] Patent Number: 5,801,626

[45] Date of Patent: Sep. 1, 1998

[54] ALARM COMMUNICATIONS SYSTEM WITH SUPERVISION SIGNAL RSSI ANALYSIS

[75] Inventor: Kenneth L. Addy, Massapequa, N.Y.

[73] Assignee: Pittway Corporation, Chicago, Ill.

[21] Appl. No.: 685,539

[22] Filed: Jul. 24, 1996

Related U.S. Application Data

[63] Continuation-in-part of Ser. No. 650,292, May 20, 1996.

[51] Int. Cl.[6] ..... G08B 1/08

[52] U.S. Cl. ..... 340/539; 340/506; 340/514

[58] Field of Search ..... 340/539, 506, 340/514, 825.69, 825.72, 825.06; 364/138, 140, 141; 455/134

[56] References Cited

U.S. PATENT DOCUMENTS

| | | | |
|---|---|---|---|
| 4,101,872 | 7/1978 | Pappas | 340/539 |
| 4,191,948 | 3/1980 | Stockdale | 340/539 |
| 4,367,458 | 1/1983 | Hackett | 340/539 |
| 4,442,426 | 4/1984 | Heuschmann et al. | 340/539 |
| 4,523,184 | 6/1985 | Abel | 340/539 |
| 4,672,365 | 6/1987 | Gehman et al. | 340/539 |

*Primary Examiner*—Donnie L. Crosland

*Attorney, Agent, or Firm*—Anthony R. Barkume, P.C.

[57] ABSTRACT

A self testing wireless data communications system suitable for use with an alarm system, the receiving element of the communications system is capable of measuring the signal strength (RSSI) of the received message signal and comparing it, if it is a supervision message, to a predetermined threshold value. When the supervision RSSI signal is above the threshold, the received message is passed to the control as being validly received; when the supervision RSSI signal is not above the threshold, then the message is ignored.

9 Claims, 5 Drawing Sheets

ALARM COMMUNICATIONS SYSTEM WITH SUPERVISION SIGNAL RSSI ANALYSIS

CROSS REFERENCE TO RELATED APPLICATION

This application is a continuation-in-part of copending U.S. application Ser. No. 08/650,292, filed on May 20, 1996, which is incorporated by reference herein. This application is also related to copending U.S. application Ser. No. 08/685,716, entitled ALARM COMMUNICATIONS SYSTEM WITH INDEPENDENT SUPERVISION SIGNAL ANALYSIS, filed by the applicant on Jul. 24, 1996.

BACKGROUND OF THE INVENTION

The present invention relates to communications devices and protocols such as those used in wireless alarm systems having multiple sensors in communication with one or more receiver/control units; and in particular to such alarm systems wherein the receiving unit of the system automatically provides an indication as to the signal strength of a received supervision signal by measuring the signal strength of the signal and comparing it against a predetermined threshold.

Most radio frequency (RF) wireless security systems available today, such as those manufactured by ADEMCO, generally employ a multiplicity of transmitter products which transmit information to a common receiver/control. The information transmitted typically describes the state of various transducers associated with each transmitter, such as smoke, motion, breaking glass, shock and vibration detectors; door, window and floor mat switches; etc. These transmitter products are designed to be low in cost and are typically send-only devices, as opposed to send/receive, or transceiver, devices which are significantly more expensive. In order to meet basic regulatory agency requirements, the transmitters are required to transmit periodic supervision transmission signals in order for the control to monitor proper operation of all of the transmitters in a given system. The supervision signal (as well as an alarm signal) has a unique identification code embedded in its data message, which serves to identify to the system control which particular transmitting device has sent that supervision (or alarm) message. Typically, when a supervision signal is properly received and detected by the receiver unit, the transmitter identification code is supplied to the system control for further processing.

For life safety applications, the RF wireless system must also comply with more stringent regulations, such as the Underwriters Laboratories regulation UL864. This regulation additionally requires that the supervision signal be reduced in transmission power level below that of the alarm (normal, non-supervision) signal transmission by a minimum of 3dB or by other equivalent means, to ensure that the alarm signal has an effective power margin over that of the periodic supervision signals from each transmitter in the system.

To employ transmitter-only products that would accurately transmit an alarm signal at the maximum allowable level and to reduce that power level by a minimum of 3dB during the periodic supervision signal transmission would add significant additional cost to each transmitter product. Furthermore, most transmitter circuits were designed prior to the advent of the regulations such as the UL864 requirement, making it necessary to redesign and replace all of the transmitter circuits presently on the market despite the fact that they already meet all of the other applicable UL, FCC, and other regulatory requirements.

This problem is addressed by the inventors of copending application Ser. No. 08/650,292. In that application, the inventors describe a novel system wherein the receiver detects the reception of a supervision signal, and then modifies an operational parameter of the receiver, such as reducing the receiver sensitivity by 3dB, for subsequent data reception. When the next message in the supervision signal pentad (which is five messages in a row) is detected at this reduced receiver sensitivity within a predetermined time, then that supervision signal is flagged as passing the margin test and the control is provided with the data message. If no next supervision signal received, then the first message is ignored and the control is not informed of its reception. Thus, if a transmitter is transmitting signals which do not provide the power margin over normal alarm signals as required by the regulations, then it is not accepted by the system.

If a message is received from a different transmitter while the receiver sensitivity is reduced, then it must be strong enough to pass the 3dB reduction, even if it is not a supervision signal. The present invention has been implemented in order to provide automatic testing of the received supervision signal without modifying its receive sensitivity or other operational parameter for subsequent messages, but rather by performing such tests in real-time on the first detected supervision message.

It is therefore an object of the present invention to provide a communications system suitable for use with an alarm system which provides for effectively reducing the supervision signal strength without modification of the supervision signal generated by the transmitting device.

It is a further object of the present invention to provide a method of measuring the signal strength of received messages and to compare the measured signal strength against a predetermined threshold, which must be exceeded for the supervision message to be accepted as valid.

It is still a further object of the present invention to provide for the logical prevention of the transmitter identification code from being sent to the system control during a supervision transmission from that transmitter if the received signal level of a supervision message does not exceed the predetermined threshold.

It is still a further object of the present invention to provide for the logical allowance of the transmitter identification code to be sent to the system control if the received signal level of a supervision message exceeds the predetermined threshold.

It is yet a further object of the present invention to ensure that alarm messages are always received at the maximum sensitivity and sent to the control system, i.e. alarm messages are always received at full sensitivity and not subjected to the predetermined threshold.

It is still a further object to provide an effective method of differentiating between supervision and alarm transmissions.

It is still a further object of the present invention to provide a method of imposing a higher effective receive threshold for supervision messages.

It is still a further object of the present invention to provide a method which can operate on data formats wherein multiple messages are sent at each transmission event and where the format contains a specific bit to indicate a supervision message and may utilize single or multiple messages.

SUMMARY OF THE INVENTION

In accordance with these and other objects, the present invention is a method for automatically testing a communications system, the communications system comprising a plurality of remote transmitting devices and a receiving station having a receiver associated therewith, each of the remote transmitting devices capable of transmitting a supervision signal and a non-supervision signal. The method comprises the steps of receiving at the receiving station a signal from a transmitting device, generating an RSSI (received signal strength indication) signal indicative of the signal strength of the received signal, and determining if the received signal is a supervision signal or a non-supervision signal. When the received signal is determined to be a supervision signal, then it is determined if the generated RSSI signal is above a predetermined threshold level, and the received signal is subsequently processed as being a validly received supervision signal when the RSSI signal is above the predetermined threshold level. The received signal is not processed as being a validly received supervision signal when the generated RSSI signal is not above the predetermined threshold level. When the received signal is determined to be a non-supervision signal, then the received signal is subsequently processed as being part of a validly received non-supervision signal without determining if the received signal is above the predetermined threshold level.

The present invention is implemented by system comprising a plurality of remote devices, each of the remote devices comprising means for transmitting supervision signals and non-supervision signals, and a receiving station. The receiving station comprises means for receiving the supervision signals and the non-supervision signals, means for generating an RSSI signal indicative of the signal strength of the received signal, signal type determination means for determining if the received signal is a supervision signal type or a non-supervision signal type, comparison means for comparing the RSSI signal to a predetermined threshold, and means for disallowing further processing of the received signal when the signal type determination means indicates that the received signal is a supervision type signal and when the comparison means indicates that the RSSI signal is below the predetermined threshold.

DETAILED DESCRIPTION OF THE PREFERRED EMBODIMENT

Figure 1:
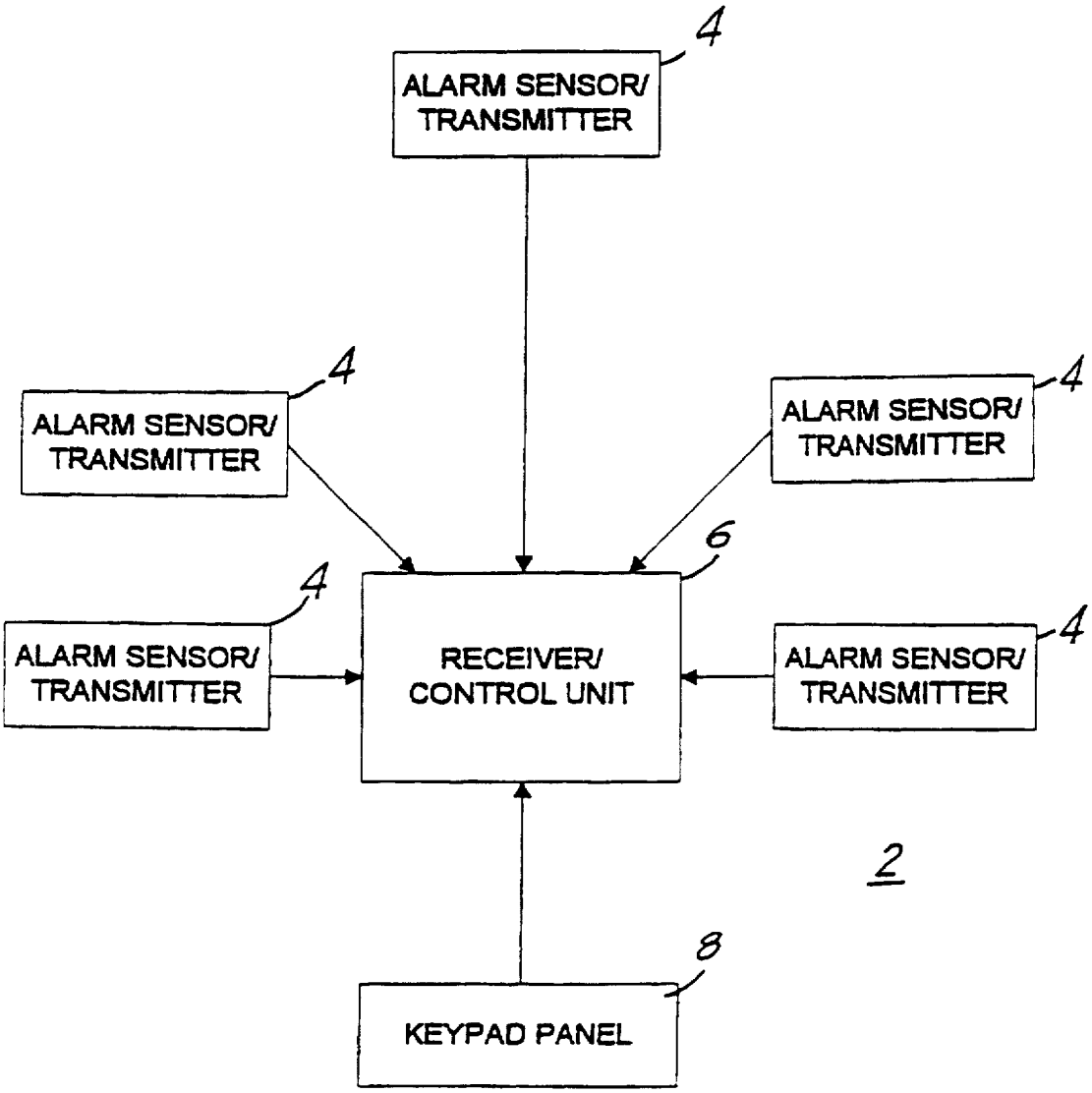
FIG. 1 is a block diagram of the preferred embodiment of the present invention.

Referring to FIG. 1, an alarm system 2 is shown, which includes a receiver/ control unit 6 in communications with a plurality of remote devices 4, each of which comprise an alarm sensor and a data transmitting unit. The alarm sensors are well known in the prior art and include, for example, motion detectors, fire or smoke sensors, glass breakage sensors, door or window entry sensors, and the like. In the preferred embodiment, the alarm system 2 operates in a so-called "wireless" fashion by electromagnetic wave transmission (radio frequency in particular) between the remote devices 4 and the receiver/control unit 6. The transmitter units housed within each remote device 4 are also well known in the art, and transmit supervision and alarm message signals (non-supervision signals), to be described below, by modulating a high frequency RF signal (e.g. 345 MHz). The modulated RF signal is received, processed and decoded by the receiver/control unit 6 so that the control unit is provided with the data from the remote devices 4 and may act accordingly; e.g. by sounding an alarm speaker, dialing a police or fire station, etc. Further description of this type of wireless alarm system may be found in U.S. Pat. No. 4,754,261 to Marino, which is owned by the assignee of the present invention and is incorporated by reference herein.

The remote devices 4 are configured to transmit supervision signals and alarm signals in accordance with protocol known in the art. The supervision signals function to provide periodic "test" signals to the receiver/control unit 6 for the purpose of ensuring that each remote device 4 configured with the system 2 is in proper communication with the receiver/control unit 6. Since it is possible in this type of system that a remote device 4 may only transmit an alarm signal at a time of an emergency (i.e. when a window associated with the sensor is broken), it is imperative that the system 2 maintain a periodic method of ensuring that a device 4 is in proper communication with the receiver/control unit 6 so potential problems may be attended to promptly.

Thus, a supervision signal is periodically sent from each remote device 4 in the system to the receiver/control unit 6 for monitoring purposes. In the preferred embodiment, with reference to FIG. 2, a supervision transmission sequence consists of a single pentad, which is a single group of five identical messages. Each message is approximately 20 ms in duration and is repeated every 100 ms. A normal, non-supervision alarm signal, which is transmitted typically only when a change in status of the alarm sensor occurs (e.g. when a door is opened), consists of a double pentad, which is two groups of five identical messages separated in time by approximately 1 second.

Figure 2:
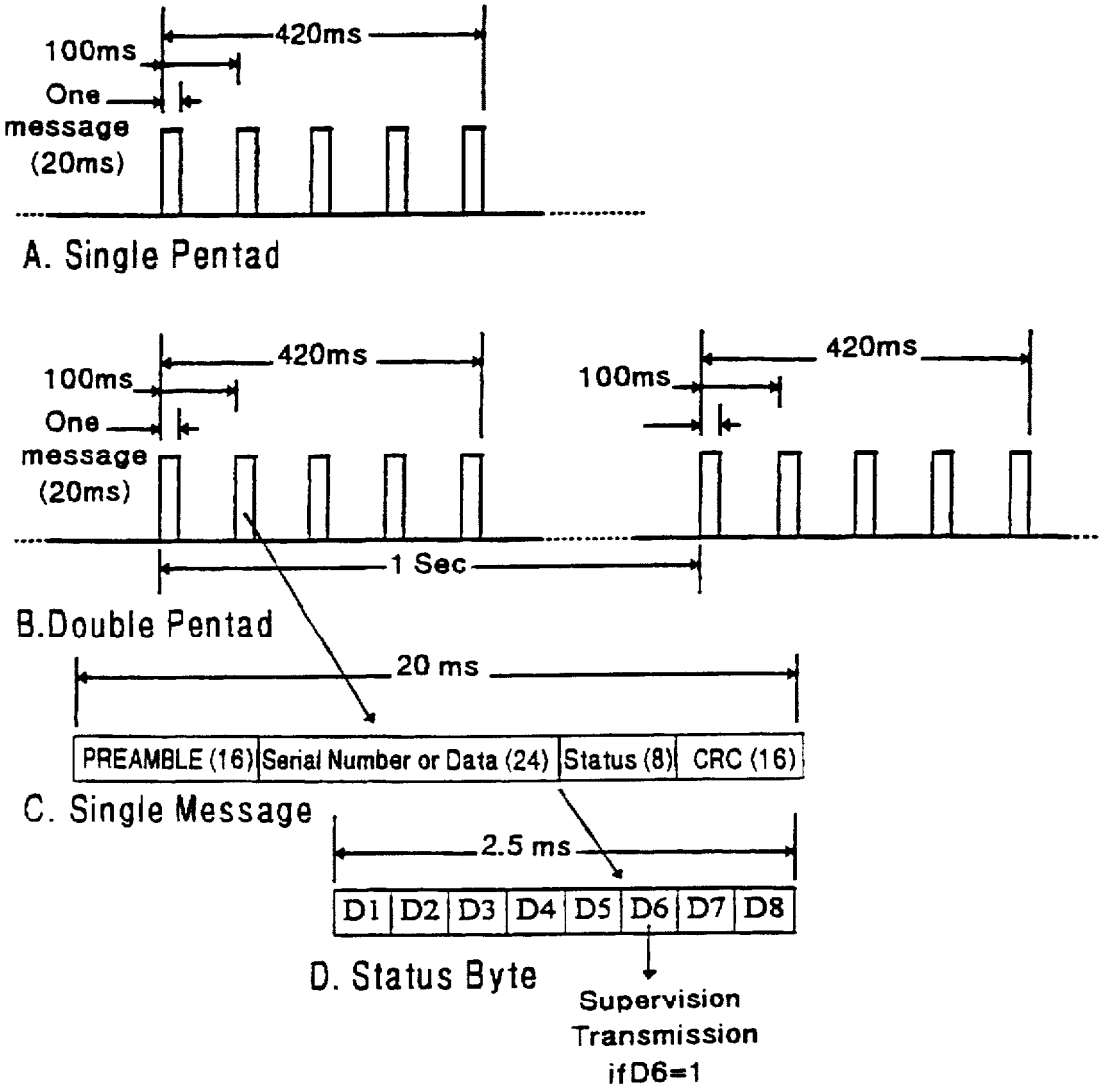
FIG. 2 is a timing diagram of supervision and non-supervision (alarm) messages in the preferred embodiment.

Each identical message is 64 bits long and has a 16-bit preamble, 24 bits of transmitter serial number or keypad data, a single 8-bit status byte, and a 16-bit CRC (Cyclical Redundancy Character), as shown in FIG. 2. The status byte contains 8 data bits, shown as D1–D8 of FIG. 2, which convey specific information. In this embodiment, D8=1 signifies that the received message was from a transmitter which is capable of generating supervision transmissions, whereupon D1–D4 represent the state of up to 4 sensor inputs to that transmitter, D5 indicates the state of that transmitter's battery, and D6=1 indicates that the received message was part of a supervision single pentad transmission. In this manner, the receiver circuitry is provided with coded information from the transmitter unit which enables it to determine if the message is part of a supervision signal or part of a normal, non-supervision alarm signal.

During the preamble portion of a received message, a decoding algorithm implemented with a microprocessor determines the necessary timing information required for subsequent decoding of the data portion and CRC of the message.

Figure 3:
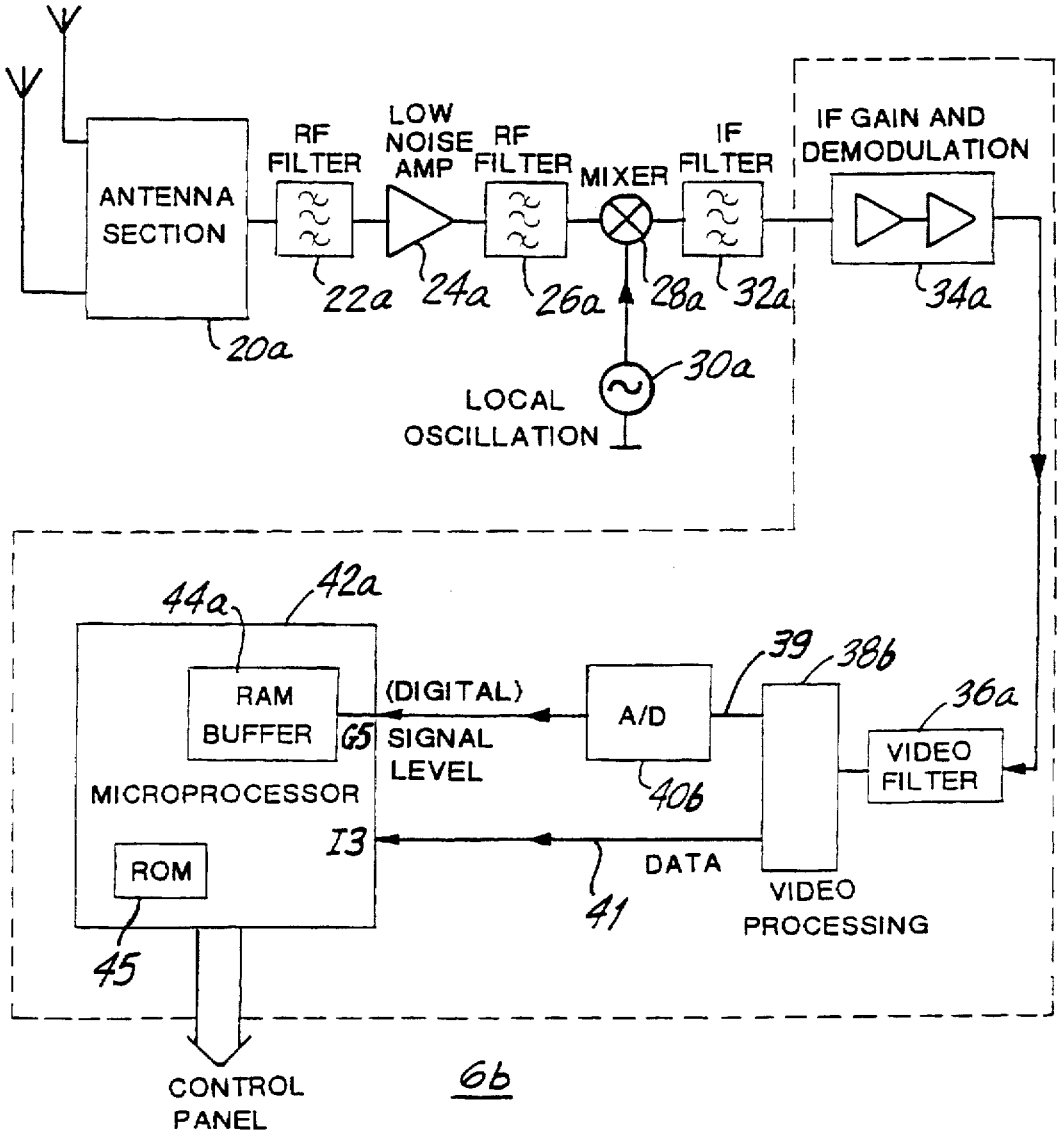
FIG. 3 is a block diagram of the receiver/control unit according to the preferred embodiment of the present invention.

FIG. 3 illustrates the circuit block diagram for the receiver/control unit 6 of the present invention. The receiver comprises an antenna selection circuit 20, an RF filter 22, a low noise amplifier 24, a second RF filter 26, a mixer 28, a local oscillator 30, an IF filter 32, an IF gain and demodulation circuit 34, and a video filter 36, which are all well known in the art of RF receivers. In addition, a demodulated baseband video signal is fed from the video filter 36 to a video processing circuit 38. The video processing circuit 38 provides a received signal strength indication (RSSI) signal 39 in analog format which is indicative of the signal strength of the received signal. RSSI measurement circuits are well known in the art, as set forth for example in U.S. Pat. No. 4,620,114; 5,390,365; and 5,423,064. The video processing circuit 38 also outputs to a port I3 on the microprocessor 42 the processed received signal. The analog RSSI signal 39 is processed by an A/D converter 40, well known in the art, and the resulting digital data word indicative of the signal strength of the received signal is input to the microprocessor port G5 for further processing. The A/D port is followed by an adequately sized RAM buffer 44 to store the digital RSSI data word should the data message on signal 41 be determined to be a supervision type and further processing is required.

Figure 4:
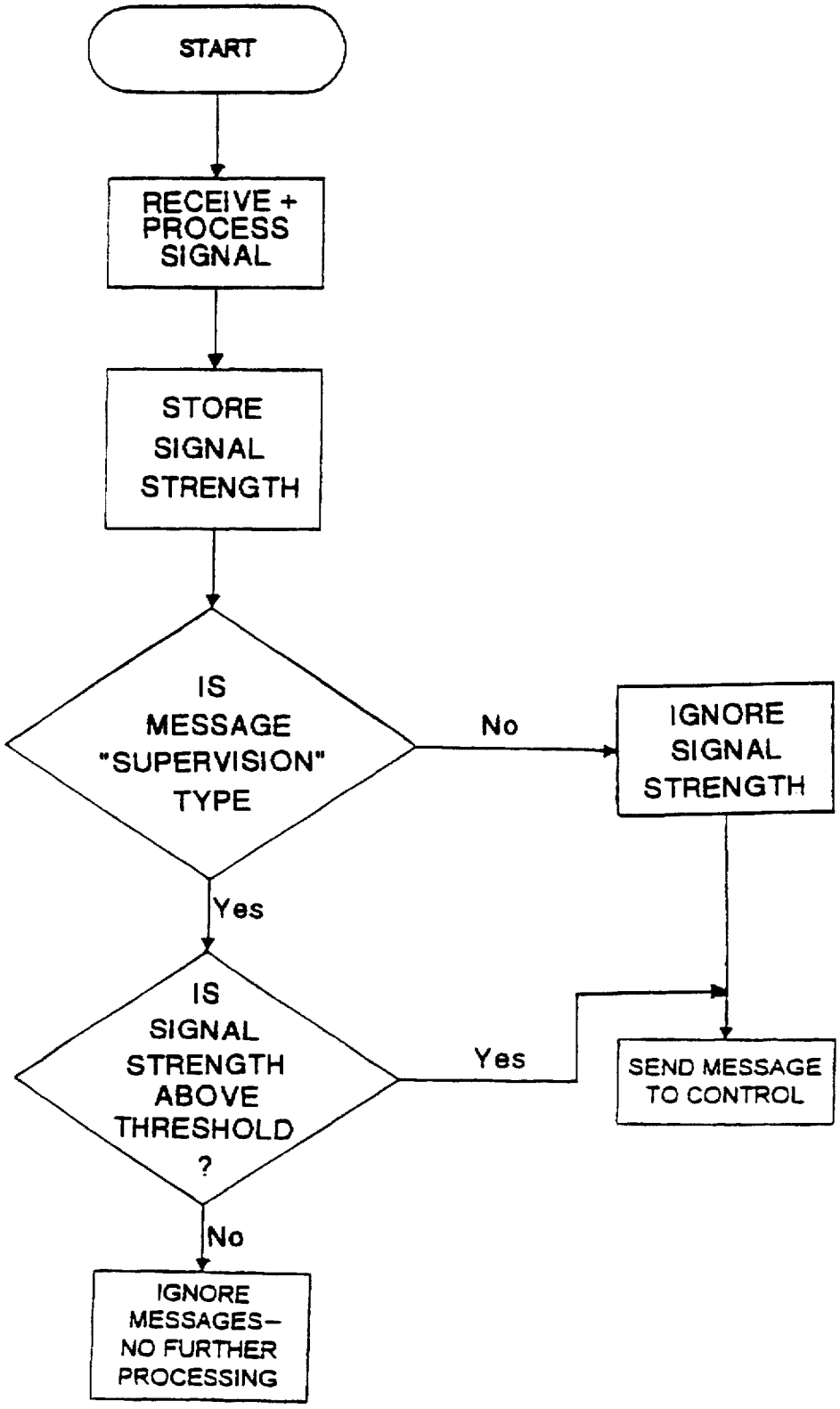
FIG. 4 is a flow chart of the operation of the preferred embodiment of the present invention.

Reference is now made to the flowchart of FIG. 4. The input signal is received and processed by the aforementioned RF components, and two data signals are derived; the actual data signal 41, which is input to the microprocessor 42 at port I3, and the digital RSSI data word, which is input serially to the microprocessor at port G5. The RSSI data word is then stored in the internal RAM buffer 44. Concurrently, the microprocessor examines the D6 bit of the signal input at I3. If it is determined to be a non-supervision (alarm) signal, then the RSSI word stored in the RAM 44 is ignored, and the message from I3 is sent to the control. If, however, it is determined that the received data message is a supervision type, then the microprocessor 42 compares the RSSI word stored at RAM 44 with a predetermined threshold stored in a non-volatile buffer 45, and if the RSSI word is above the predetermined threshold, then the test has passed and the supervision message is sent to the control. If however, the RSSI word is not above the predetermined threshold, then the received signal is ignored, the test is considered to have failed, and the control is not provided with information that the supervision message was received. Thus, the transmitter identification data and other status data are sent to the control system if the message is an alarm type or if it is a supervision type received with adequate signal level.

The threshold value used for comparison against the measured RSSI word may be ascertained in various ways. In one embodiment, the RSSI threshold may be preset at the factory by typical programming techniques. Alternatively, the RSSI threshold may be programmed by the system installer, who may take measurements during initial operation of the system to determine the proper threshold to use in accordance with the particular environment. Thirdly, the microprocessor may be configured with techniques known in the art to make certain measurements of received signals, and determine an average threshold to use accordingly.

Figure 5:
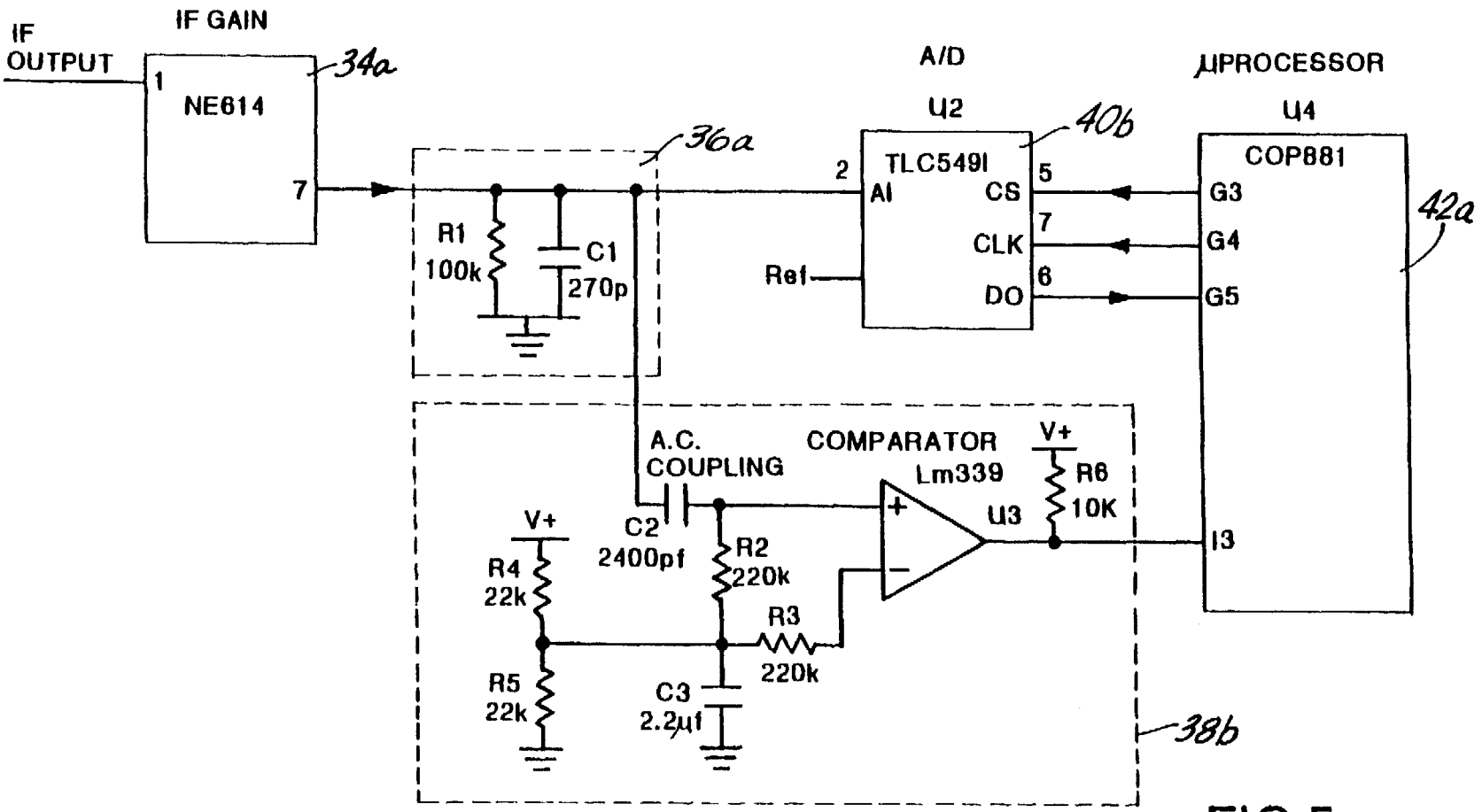
FIG. 5 is a detailed schematic of the processing portion of the block diagram of FIG. 3.

FIG. 5 illustrates the detailed schematic of the dotted line portion of FIG. 3. IF/demodulator integrated circuit 34, which in the preferred embodiment is a Philips NE614, utilizes the IF input signal and provides at its output a demodulated data signal to the low pass filter 36 formed by R1 and C1. The low pass filter 36 reduces the noise content of the video output signal. The filtered video signal is then AC coupled via capacitor C2 to the non-inverting input of the U3 comparator (LM339), which quantizes the signal to a logic level suitable for input to the microprocessor 42. The combination of R4 and R5 form a voltage divider, which sets a slicing level for the reference voltage applied to the inverting input to the U3 comparator. Capacitor C3 provides an AC ground for the U3 comparator reference input.

The output signal of comparator U3 is input to I3 of the microprocessor 42. The microprocessor in the preferred embodiment is a COP881 available from National Semiconductor. In particular, the output from U3 is fed to port I3 of the microprocessor, and is at the normal sensitivity level.

The filtered demodulated data signal is also input to an analog-to-digital (A/D) circuit 40, which provides a digital output representative of the input signal in accordance with techniques well known in the art. In the preferred embodiment, a Texas Instruments TLC549I is used. A serial digital data word is then input to the port G5 of the microprocessor 42 for storage in the internal RAM 44 and subsequent analysis as described above.

The preferred embodiment has been described with reference to a system wherein a single message is transmitted at each transmission event and includes in the message a specific bit to designate a supervision message. Those skilled in the art will recognize that a message is often repeated to improve probability of reception and in addition a specific supervision bit may not be included. In this type of system a supervision transmission may be differentiated from an alarm transmission by the number of repeats of each message. There are regulatory requirements that a supervision message be repeated less often than an alarm message. In these cases, the system described in the present invention will discern whether a message is a supervision type by counting the number of repeats of a received message before deciding whether or not to perform the RSSI analysis.

It may also be desired to only perform the automatic self-test functions of the present invention as herein described on certain remote devices rather than on each one. That is, regulatory requirements may only mandate that life safety devices or applications be tested in this manner, while other devices in the system need not meet such rigorous communications standards. In such a system, the processing circuitry and software is provided with further intelligence in order to determine which supervision messages are to undergo RSSI measurements. This may be accomplished by designating a flag bit in the message as a test/no-test bit, wherein a logic true indicates that the transmission margin be tested, and a logic false indicates that the test need not be done. Alternatively, the processor may implement a look-up table programmed with the identity of each device which is to undergo the transmission margin test, and thus utilize the device identification code to access the table and process the message accordingly.

Thus while the particular embodiments of the present invention have been shown and described, various modifications will be apparent to those skilled in the art, and therefore it is not intended that the invention be limited to the disclosed embodiment or to details thereof and departures may be made therefrom within the spirit and scope of the present invention.

I claim:

1. In a communications system comprising a plurality of remote transmitting devices and a receiving station having a receiver associated therewith, each of said remote transmitting devices capable of transmitting a supervision signal and a non-supervision signal, a method for automatically testing the communications system comprising the steps of:

a) receiving at said receiving station a signal from a transmitting device;

b) generating an RSSI signal indicative of the signal strength of said received signal;

c) determining if said received signal is a supervision signal or a non-supervision signal;

d) when said received signal is determined to be a supervision signal, then performing the steps of:

i) determining if said RSSI signal is above a predetermined threshold level;

ii) subsequently processing said received signal as being a validly received supervision signal when said RSSI signal is above said predetermined threshold level; and iii) not processing said received signal as being a validly received supervision signal when said RSSI signal is not above said predetermined threshold level; and e) when said received signal is determined to be a non-supervision signal, then subsequently processing said received signal as being part of a validly received non-supervision signal without determining if said received signal is above said predetermined threshold level.

2. The method of claim 1 wherein said transmitting devices and said receiver communicate with electromagnetic wave transmission.

3. The method of claim 2 wherein said electromagnetic wave transmission is radio frequency wave transmission.

4. The method of claim 1 wherein said communications system is an alarm system, at least one of said remote transmitting devices is associated with an alarm sensor, and wherein said non-supervision signal from said transmitting device associated with an alarm sensor is an alarm signal comprising alarm messages encoded with alarm sensor data.

5. A self-testing data communications system comprising a) a plurality of remote devices, each of said remote devices comprising means for transmitting supervision signals and non-supervision signals;

b) a receiving station comprising:

i) means for receiving said supervision signals and said non-supervision signals;

ii)means for generating an RSSI signal indicative of the signal strength of the received signal;

iii) signal type determination means for determining if said received signal is a supervision signal type or a non-supervision signal type;

iv) comparison means for comparing said RSSI signal to a predetermined threshold;

v) means for disallowing further processing of said received signal when said signal type determination means indicates that said received signal is a supervision type signal and when said comparison means indicates that said RSSI signal is below said predetermined threshold.

6. The communications system of claim 5 wherein said remote devices and said receiving means communicate by electromagnetic wave transmission.

7. The communications system of claim 6 wherein said electromagnetic wave transmission is radio frequency wave transmission.

8. The communications system of claim 5 wherein at least one of said remote devices is associated with an alarm sensor.

9. A receiving station for use in a data communications system comprising a plurality of remote devices, each of said remote devices having a transmitter for transmitting supervision signals and non-supervision signals, said receiving station comprising:

a) means for receiving said supervision signals and said non-supervision signals;

b) means for generating an RSSI signal indicative of the signal strength of the received signal;

c) signal type determination means for determining if said received signal is a supervision signal type or a non-supervision signal type;

d) comparison means for comparing said RSSI signal to a predetermined threshold; and e) means for disallowing further processing of said received signal when said signal type determination means indicates that said received signal is a supervision type signal and when said comparison means indicates that said RSSI signal is below said predetermined threshold.

* * * * *